US010662744B2

(12) United States Patent
Head

(10) Patent No.: US 10,662,744 B2
(45) Date of Patent: May 26, 2020

(54) LATERAL DRILLING SYSTEM

(71) Applicant: Octopus Completions LTD, Bagshot, Surrey (GB)

(72) Inventor: Philip Head, Virginia Water Surrey (GB)

(73) Assignee: Octopus Completions Ltd., Surrey (GB)

( * ) Notice: Subject to any disclaimer, the term of this patent is extended or adjusted under 35 U.S.C. 154(b) by 45 days.

(21) Appl. No.: 15/321,368

(22) PCT Filed: Jun. 22, 2015

(86) PCT No.: PCT/EP2015/064013

§ 371 (c)(1),
(2) Date: Dec. 22, 2016

(87) PCT Pub. No.: WO2016/005178

PCT Pub. Date: Jan. 14, 2016

(65) Prior Publication Data

US 2017/0152727 A1 Jun. 1, 2017

(30) Foreign Application Priority Data

Jun. 22, 2014 (GB) ..... 1411097.7

(51) Int. Cl.
*E21B 41/00* (2006.01)
*E21B 1/00* (2006.01)
(Continued)

(52) U.S. Cl.
CPC ..... *E21B 41/0042* (2013.01); *E21B 1/00* (2013.01); *E21B 7/061* (2013.01); *E21B 7/20* (2013.01);
(Continued)

(58) Field of Classification Search
CPC ..... E21B 1/00; E21B 7/18; E21B 7/20; E21B 17/07; E21B 33/124; E21B 41/0035; E21B 41/0042; E21B 7/04; E21B 7/06
See application file for complete search history.

(56) References Cited

U.S. PATENT DOCUMENTS 4,007,797 A * 2/1977 Jeter ..... E21B 4/00 173/149
5,853,056 A * 12/1998 Landers ..... E21B 7/061 175/424
(Continued)

FOREIGN PATENT DOCUMENTS

CA 2132458 3/1996
CA 2132458 A1 * 3/1996 ..... E21B 17/042
WO WO 2012/069858 5/2012

OTHER PUBLICATIONS

International Search Report and Written Opinion of International Application No. PCT/EP2015/064013 dated Jun. 5, 2016.

*Primary Examiner* — Robert E Fuller
*Assistant Examiner* — Lamia Quaim
(74) *Attorney, Agent, or Firm* — Fay Sharpe LLP

(57) ABSTRACT

A drilling apparatus for drilling a lateral bore to main bore, comprises a casing in the main bore, having at least one window, at least one lateral tube, including a bit or other soil penetrator, the lateral tube which engages with an aperture in the casing, the outer diameter of lateral tube flush with aperture, such that the lateral tube is forced through the casing aperture into the formation when a sufficient pressure differential between the inside of the casing and the outside of the casing and a plurality of packers disposed at intervals along the outside of the casing, capable of sealing the annulus to the passage of fluids.

20 Claims, 15 Drawing Sheets

(51) Int. Cl.

| | |
|---|---|
| ***E21B 7/06*** | (2006.01) |
| ***E21B 7/20*** | (2006.01) |
| ***E21B 17/07*** | (2006.01) |
| ***E21B 33/124*** | (2006.01) |

(52) U.S. Cl.
CPC ..... *E21B 17/07* (2013.01); *E21B 33/124* (2013.01); *E21B 41/0035* (2013.01)

(56) References Cited

U.S. PATENT DOCUMENTS

| | | | | |
|---|---|---|---|---|
| 9,644,459 | B2 * | 5/2017 | Themig | E21B 41/0035 |
| 2002/0096333 | A1 | 7/2002 | Johnson et al. | |
| 2005/0241831 | A1 | 11/2005 | Steele et al. | |
| 2006/0243450 | A1 * | 11/2006 | Head | E21B 17/026 166/369 |
| 2012/0199368 | A1 | 8/2012 | Freyer | |
| 2012/0199398 | A1 * | 8/2012 | Davis | E21B 7/20 175/57 |
| 2012/0217068 | A1 * | 8/2012 | Toscher | E21B 7/04 175/61 |
| 2015/0176378 | A1 * | 6/2015 | Ramey, Jr. | E21B 43/08 166/386 |
| 2016/0097239 | A1 * | 4/2016 | Freyer | E21B 23/08 175/62 |

* cited by examiner 15.7ft
22
22
23
21

12
40ft
15.7ft
14
11
13
30
30
0.5" dia 15
16
17
18

LATERAL DRILLING SYSTEM

CROSS-REFERENCE TO RELATED APPLICATIONS

This application is a National Stage Entry of PCT/EP2015/064013, and claims priority to, and the benefit of, Great Britain Patent Application No. GB 1411097.7, filed Jun. 22, 2014, the entirety of which is hereby incorporated by reference as if fully set forth herein.

The present invention relates to lateral drilling, particularly the drilling of lateral bores branching from a main bore.

It is advantageous to drill a well horizontally through a reservoir and selectively isolate the annulus using swellable packers. That enables each zone to be selectively produced and stimulated using fracturing techniques to get the maximum production from the well.

However, fracturing uses significant quantities of fluids and a large high pressure pumping equipment spread at surface. In addition, the fracturing process is not a precise method of penetrating the reservoir and can result in the fracture penetrating undesirable areas causing a loss of hydrocarbons.

It is therefore the objective of this invention to provide apparatus and methods of using such apparatus to more efficiently and reliably create lateral bores, and in some aspects of the invention, control or provide other capabilities to the laterals' management.

According to the present invention, there is provided an apparatus for drilling a lateral bore to main bore, comprising a casing in the main bore, the casing having at least one aperture at least one lateral tube, including a bit or other soil penetrator, the lateral tube engaging with a aperture in the casing, the outer diameter of the lateral tube being flush with the aperture the lateral tube is prevented from rotating while entering the formation for a first time period until a predetermined or desired orientation between the lateral and main bore has been achieved, and at the end of the first time period, the lateral tube is free to rotate to enable a straight section of lateral hole to be drilled.

According to another aspect of the present invention, there is provided an apparatus for drilling a lateral bore to main bore, comprising a casing in the main bore, the casing having at least one aperture at least one lateral tube, including a bit or other soil penetrator, the lateral tube extending from the a aperture in the casing, the bit being a percussion drill.

According to another aspect of the present invention, there is provided a drilling apparatus for drilling a lateral bore to main bore, comprising a casing in the main bore, the casing having at least one window at least one lateral tube, including a bit or other soil penetrator, the lateral tube which engages with an aperture in the casing, the outer diameter of the lateral tube being flush with the aperture, such that the lateral tube is forced through the casing aperture into the formation when a sufficient pressure differential between the inside of the casing and the outside of the casing a plurality of packers disposed at intervals along the outside of the casing, capable of sealing the annulus to the passage of fluids.

According to another aspect of the present invention, there is provided a drilling apparatus for drilling a lateral bore to main bore, comprising a casing in the main bore, the casing having at least one window at least one lateral tube, including a bit or other soil penetrator, the lateral tube comprising at least one inner tube and one outer tube, the inner tube initially co-extensive with the outer tube, the inner tube extending telescopically to progress the lateral tube.

This allows the creation of holes in the reservoir of known size, depth, inclination and distribution along the entire reservoir, increasing the speed, efficiency and amount of production.

By way of example the following figures will be used to describe embodiments of the invention.

Figure 2:
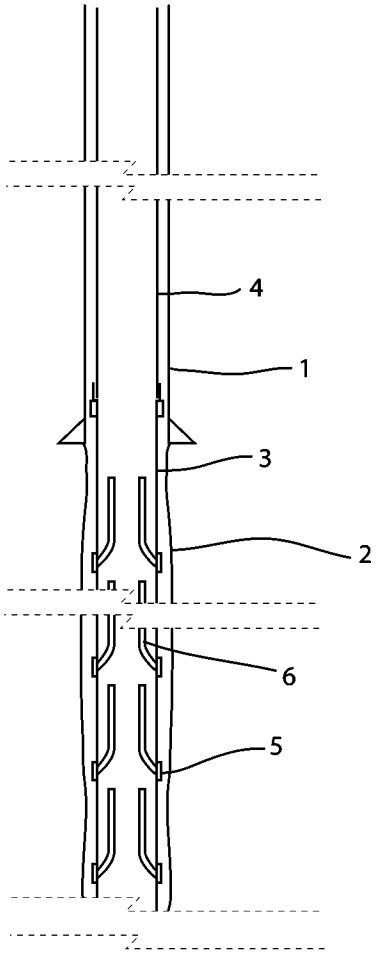
FIG. 2 is section side view of the well shown in FIG. 1 with the lower completion installed
Figure 1:
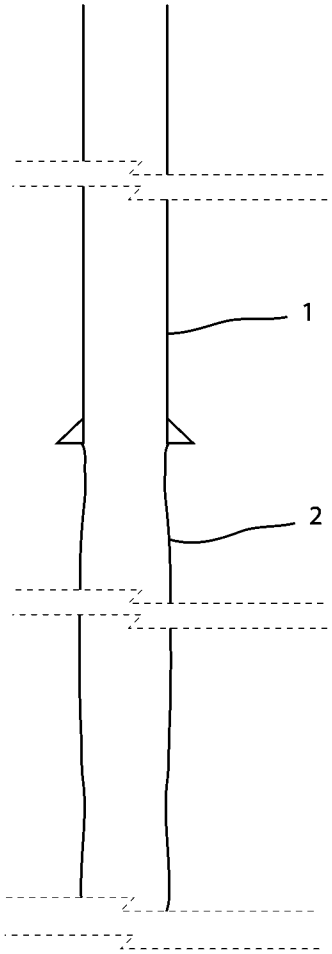
FIG. 1 is a side view illustration of a well
Figure 4A:
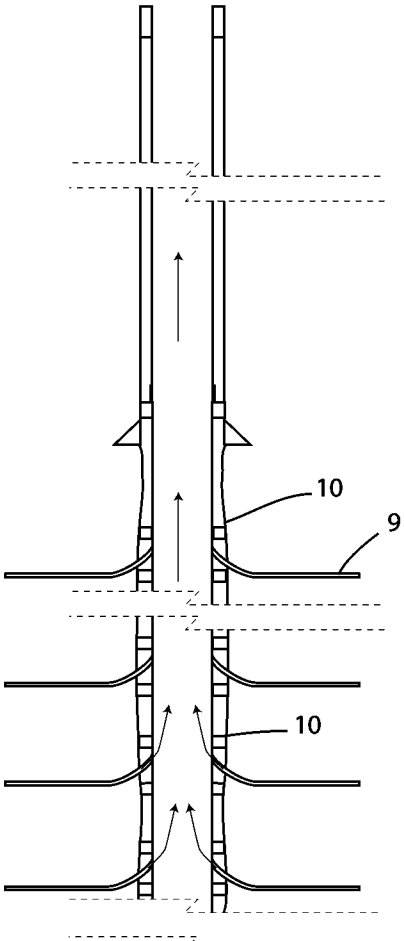
FIG. 4 is a similar view to FIG. 3, the flush outer diameter tubes extended into the reservoir and the swellable packers swollen.
Figure 4:
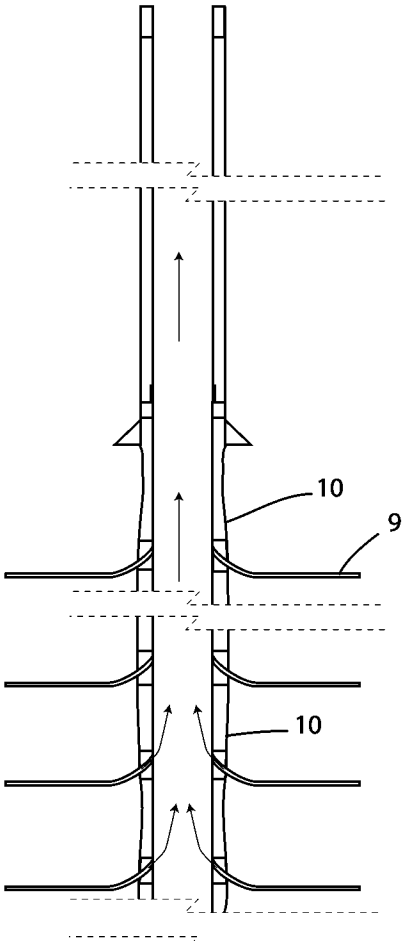

FIG. 4*a* is a similar view to FIG. 4, with a different packer arrangement.

Figure 5:
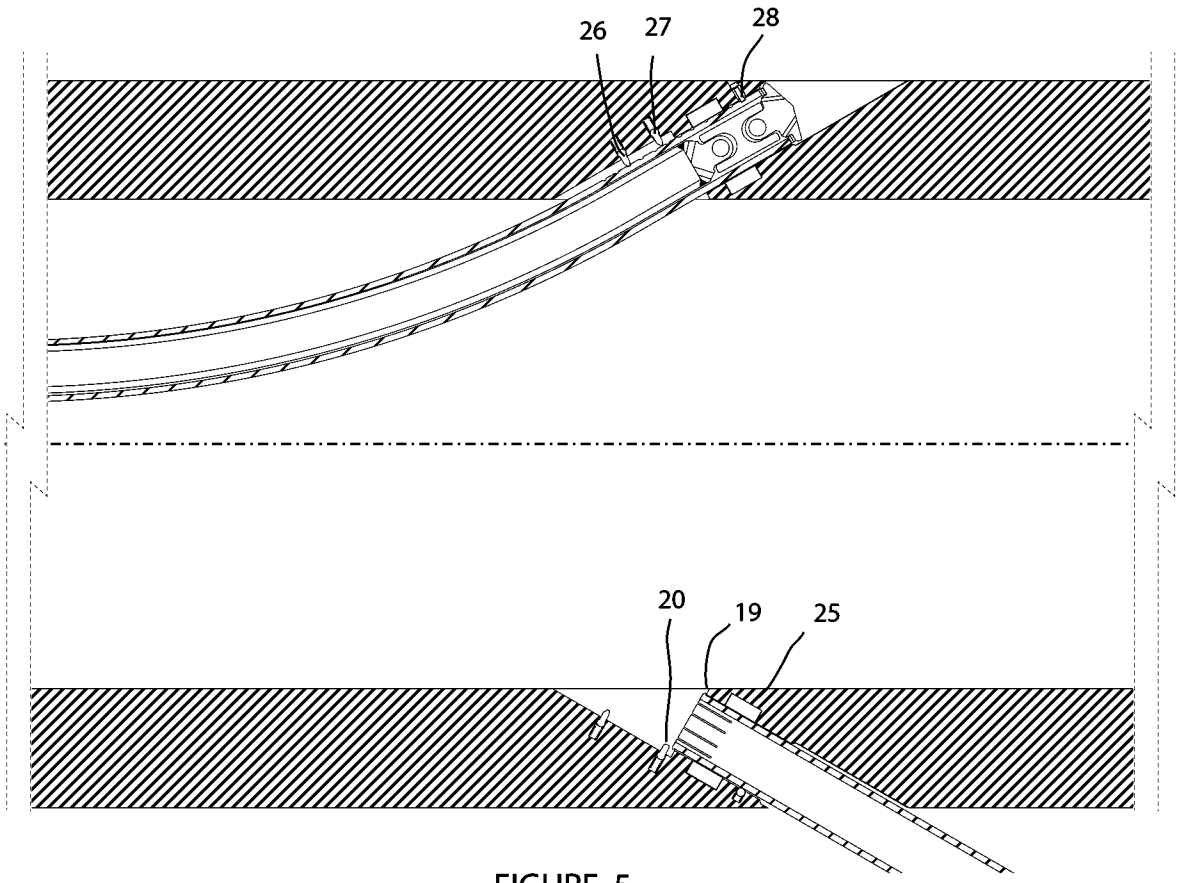

FIG. 5 is a section side view through the casing in the main bore, showing two laterals at different stages of their deployment (in practice, the laterals would usually deploy simultaneously).

Figure 5A:
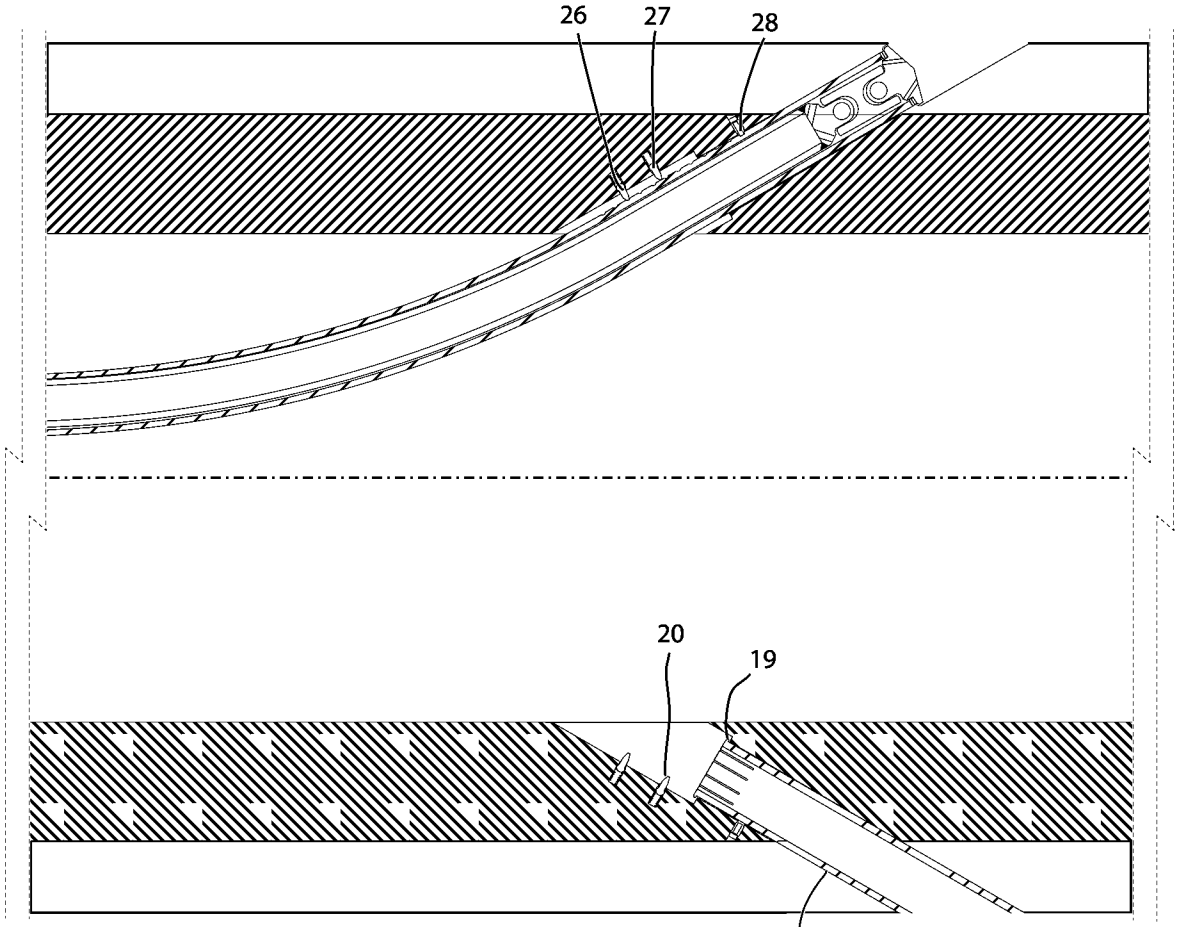

FIG. 5*a* is a section side view through the casing in the main bore of a different packer arrangement.

Figure 6:
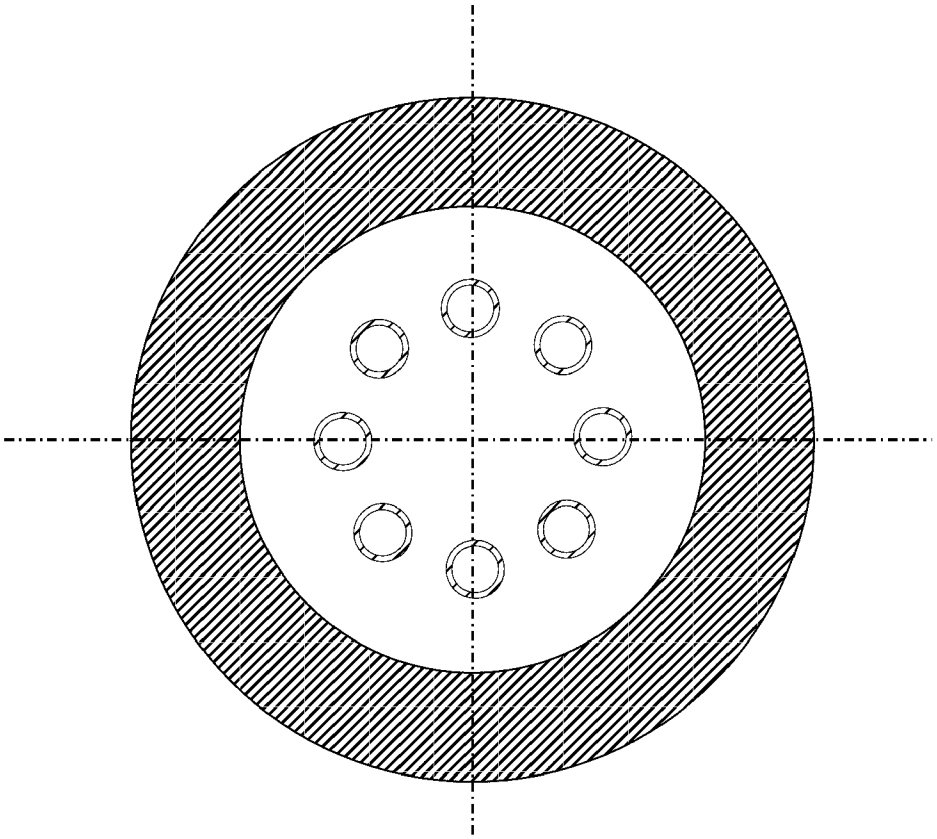

FIG. 6 is a section end view of the casing in the main bore.

Figures 7, 8, 9:
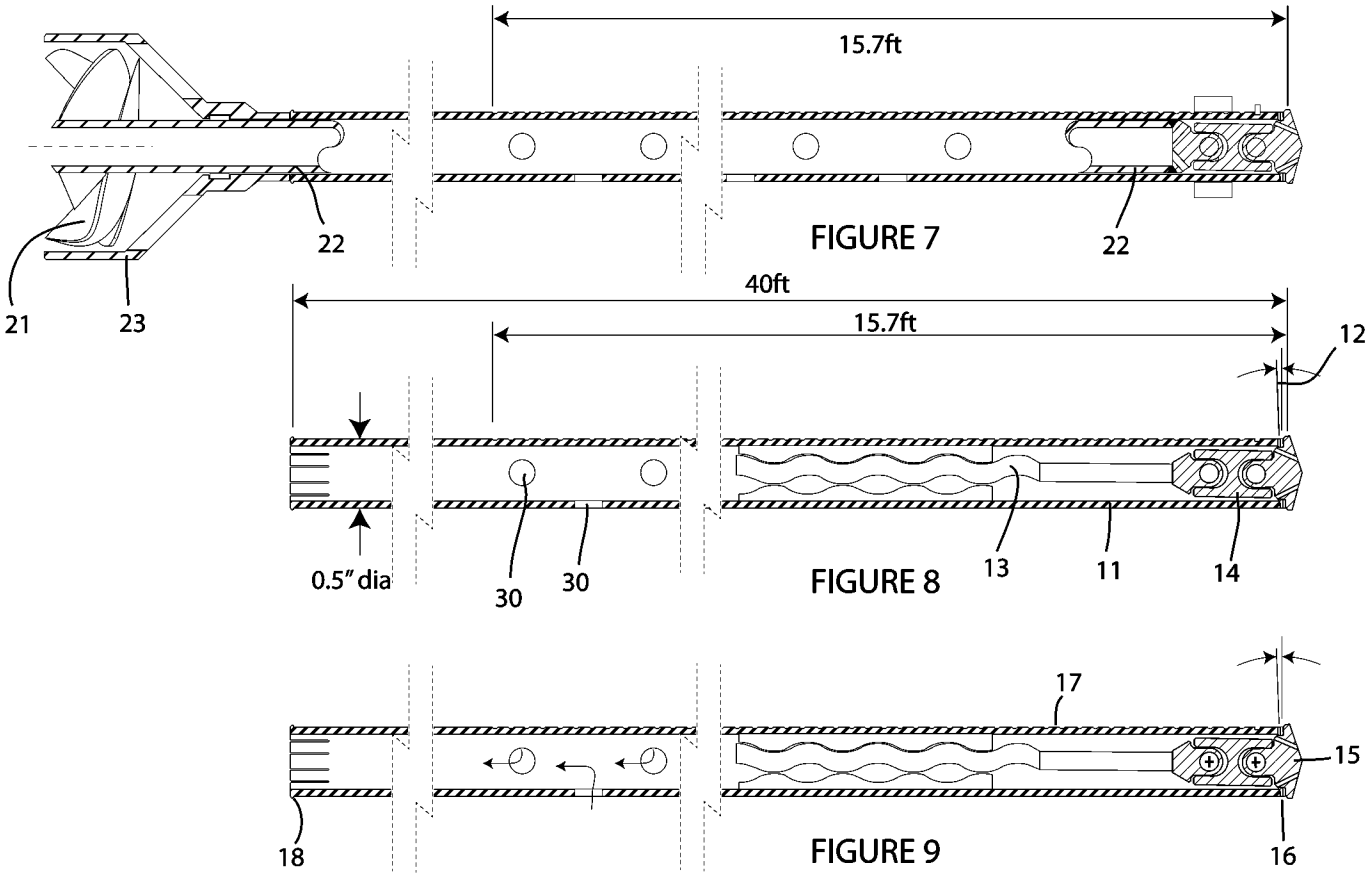

FIG. 7 is a section side view of one embodiment of the flush outer diameter tube.

FIG. 8 is a section side view of another embodiment of the flush outer diameter tube.

FIG. 9 is a similar view to FIG. 8 with acid soluble discs removed and hydrocarbons flowing into the port.

Figure 10:
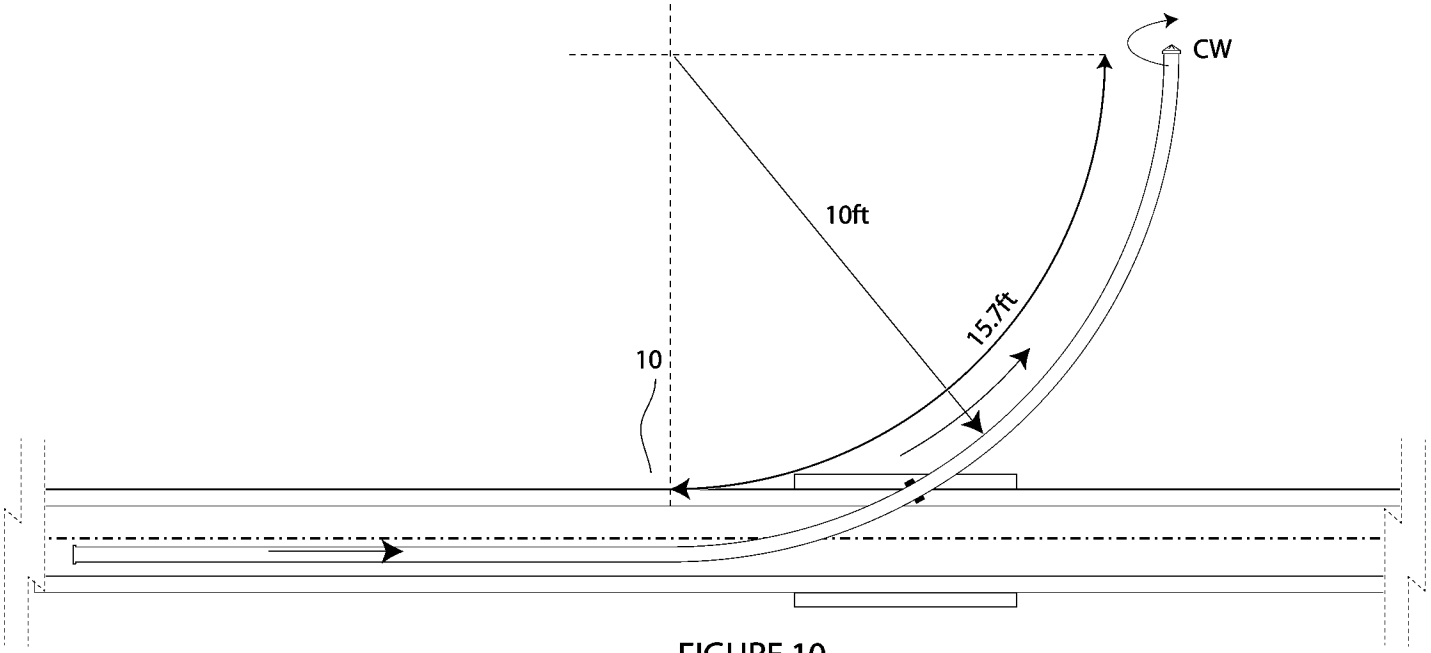

FIG. 10 shows the flush outer diameter tube being directionally drilled from the main bore.

Figure 11:
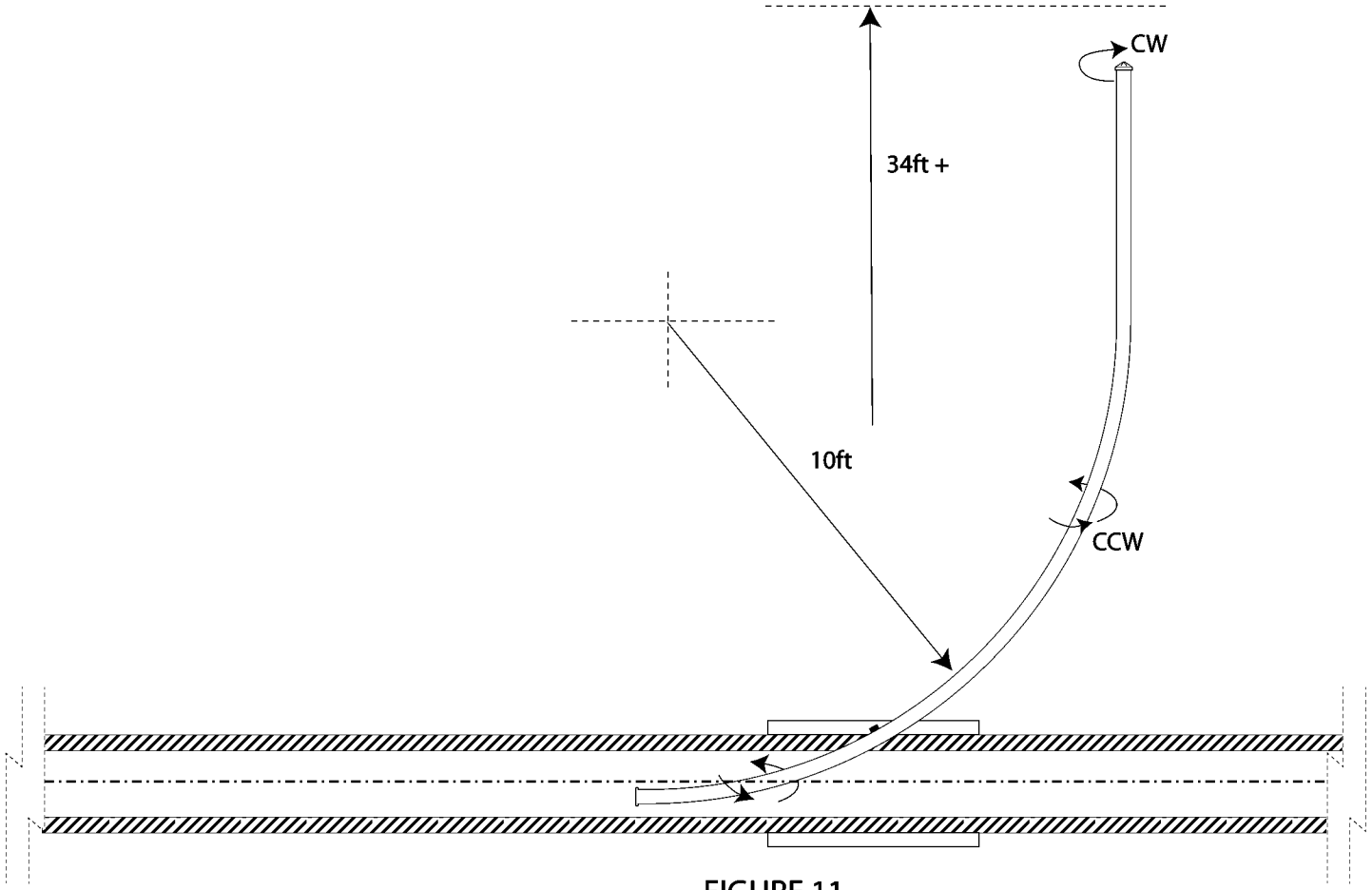

FIG. 11 is a similar view to FIG. 10 with the flush outer diameter tube being drilled 90 degrees to the main casing.

Figure 12:
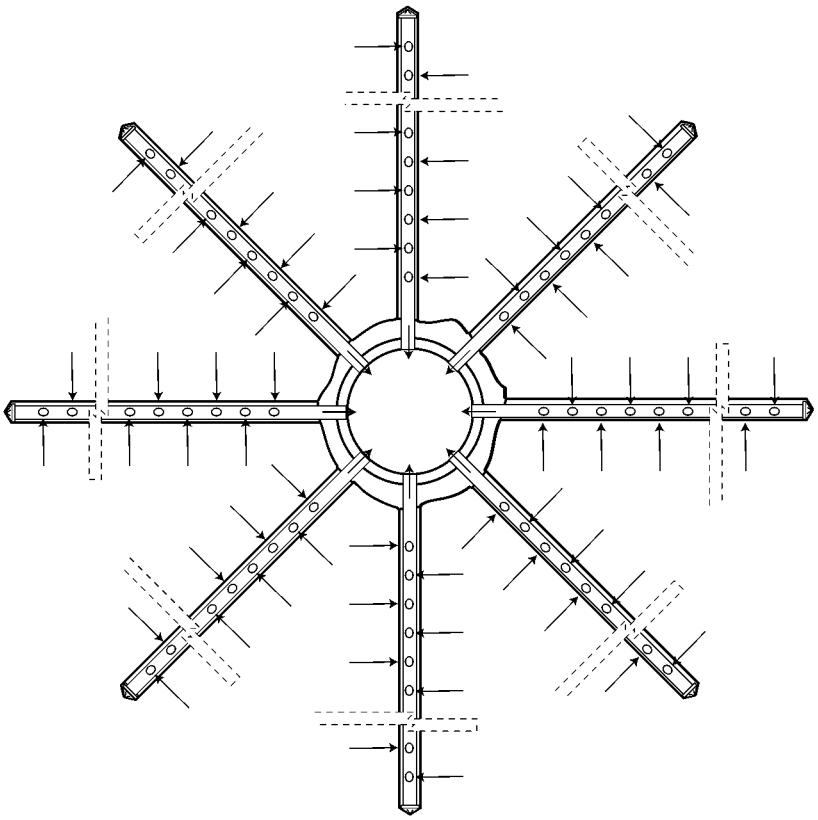

FIG. 12 is an end view cross section showing a number of laterals at one particular depth, this would be repeated along the entire reservoir.

Figure 13:
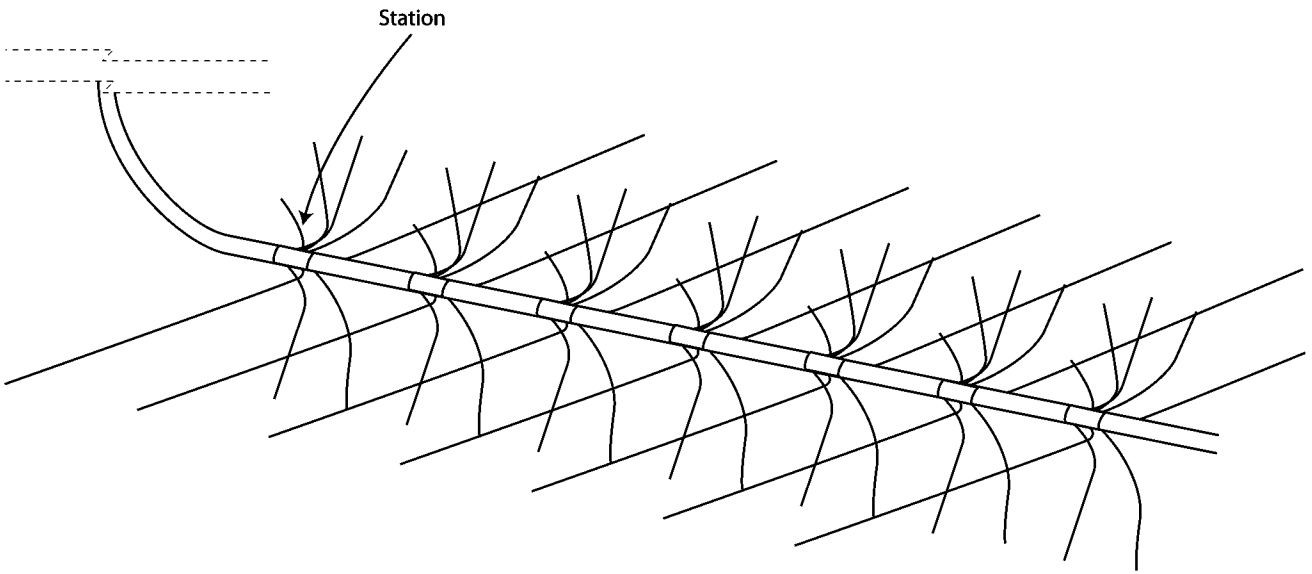

FIG. 13 is a 3D illustration of the multi station, multilateral well

Figure 14:
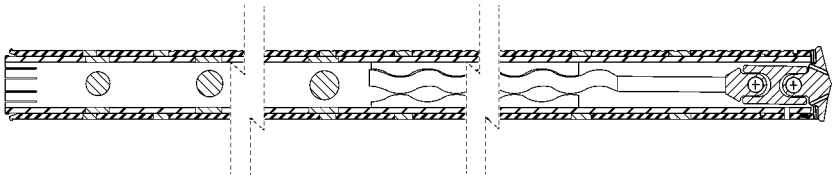

FIG. 14 is a section side view of a telescopic flush outer diameter tube.

Figure 15:
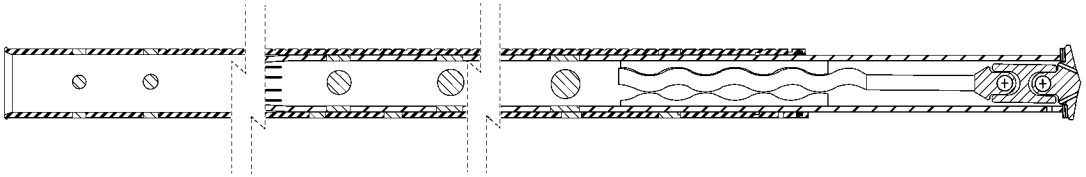

FIG. 15 is a section side view of the embodiment show in FIG. 14 with the telescopic tube being deployed.

Figure 16:
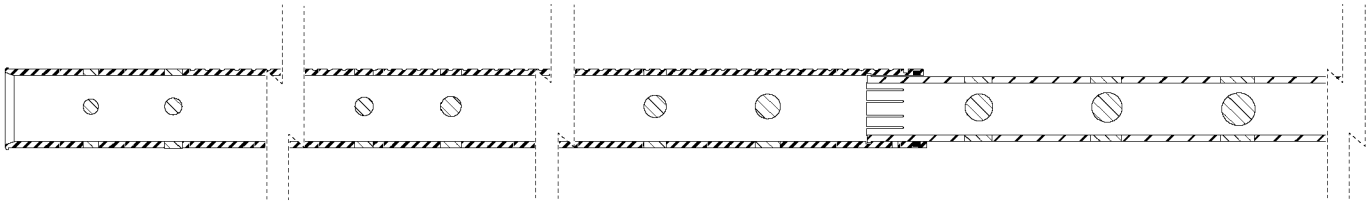

FIG. 16 is a section side view of the fully deployed telescopic tube.

Figure 17:
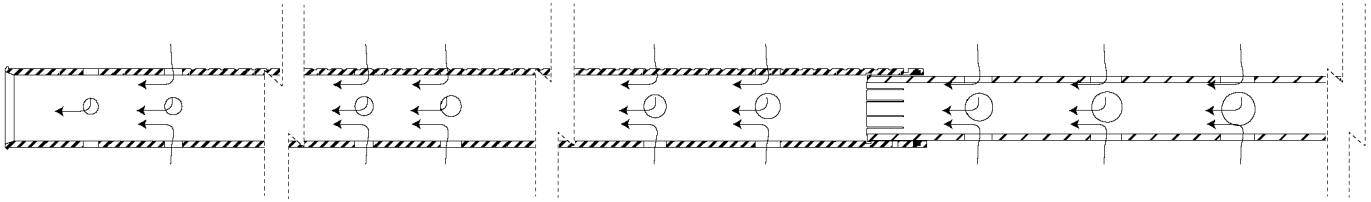

FIG. 17 is a section side view of the fully deployed telescopic tube with different diameter inflow ports opened.

Figure 18:
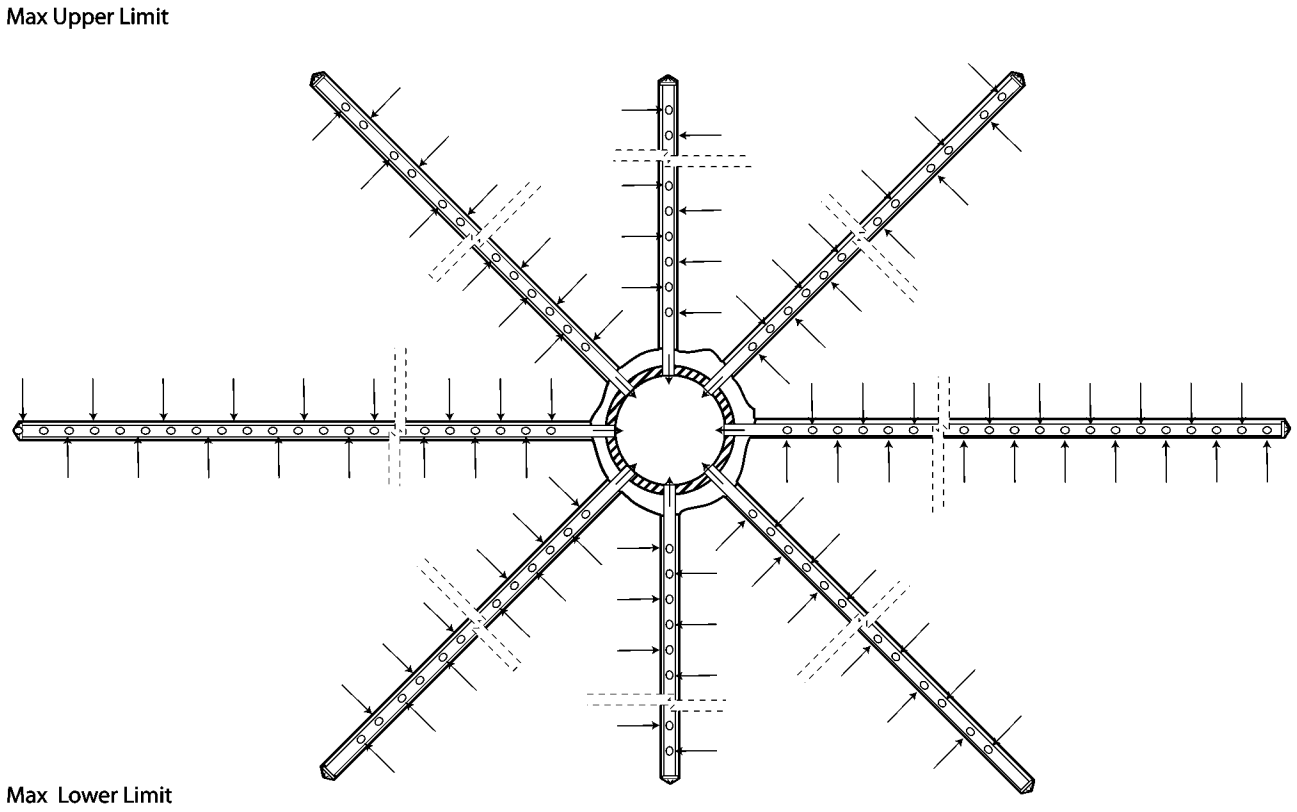
Figure 19:
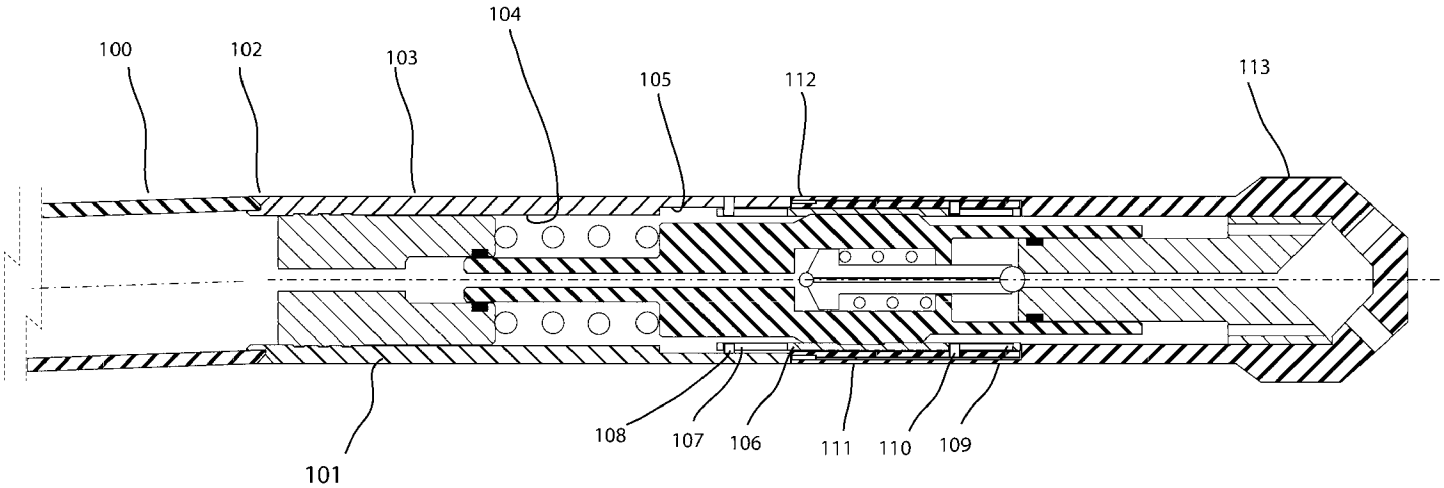
Figure 20:
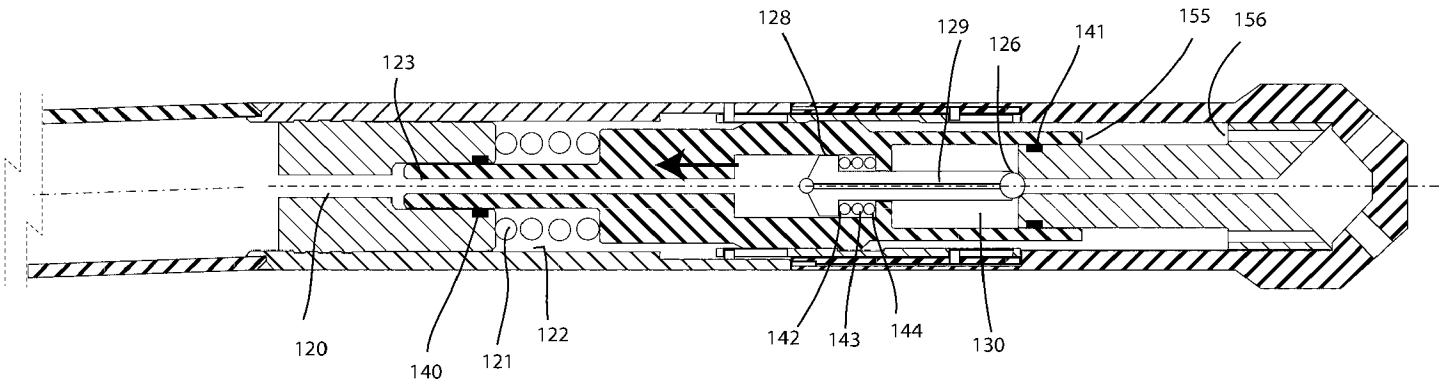
Figure 21:
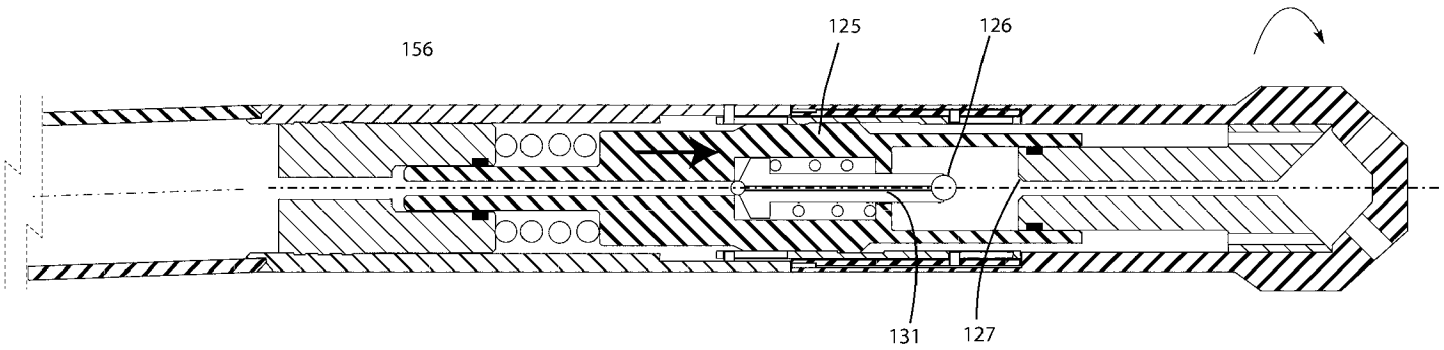

FIG. 18 is a similar view to FIG. 12, demonstrating the benefit of different length laterals FIGS. 19 to 21 are longitudinal sectional views of another embodiment of the drill bit.

Figure 3:
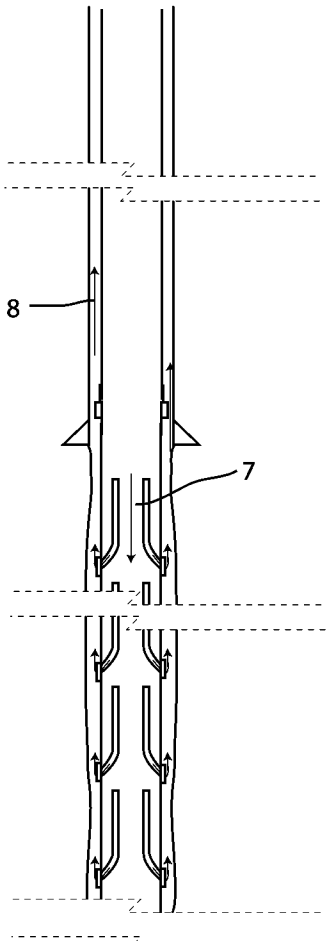
FIG. 3 is a section side view of the well shown in FIG. 2 showing fluid being circulated down the tubing from surface.

Referring to FIGS. 1 to 4 there is shown a last casing 1 and an open hole 2, which together comprise the main bore. A lower completion 3 is lowered into the main bore on tubing 4. The lower completion consists of joints of casing with internal lateral tubes generally indicated 6, and swellable packers 5. In summary, once at the required drilling depth, fluid is pumped down the inside of the tubing 7, increasing the pressure difference between the casing and the annulus, and urges the lateral tubes through apertures or windows in the casing wall. As the tips of the lateral tubes emerge from the casing, fluid pumped down the casing flows through each lateral tube and circulates back up the annulus 8 as shown in FIG. 3. After a pre-defined pumping time, all the lateral tubes 6 advance through the formation until each lateral bore 9 has been fully extended to the desired length. The casing also includes swellable packers 10 through which the lateral tubes 6 drill through. After a pre-defined time (which ideally is similar or shorter than the predetermined time needed to form the lateral bores) all the swellable packers will have swollen and sealed the annulus at their locations 10, as shown in FIG. 4. Each lateral bore tube operates independently of the other lateral tubes.

Fluid produced from the formations (i.e. hydrocarbons) flows through lateral tubes and into up the main tubing 3 of the completion to the surface. The lateral tube (if it has not been dissolved in a manner described below) has a flush inner bore through which the formation fluid can flow without obstruction. The swellable packers ensure that the formation fluid from each lateral bore cannot escape into the annulus and can only flow into the main tubing. Referring to FIG. 4*a*, in an alternative arrangement swellable packers 10' are provided above and below each vertically spaced set of laterals 6'. The annulus is compartmentalised in a similar way to the previous embodiment. Another alternative system would be to dispose a packer midway between two sets of laterals.

The construction and operation of the lateral tubes will now be described in detail.

Referring to FIG. 5, there is shown a lateral tube generally designated 6 which is located in a window 35 in casing 3. The main body of the lateral tube comprises a uniform tubular member 11 whose outer diameter matches the inner diameter of the window 35 so the lateral tube 6 is flush with the window 35.

The position of the tubular member 11 in the window is initially retained by a shear pin 28. In order to start the deployment of the lateral tube 6, the internal pressure of the casing is increased. When sufficient internal pressure is attained, the shear pin breaks, releasing the lateral tube 6 and allows the tube to be expelled from the hole 35 it is retained in by the pressure differential. The lateral tube 6 terminates in a rock drilling bit 15. This arrangement corresponds to the embodiment shown in FIG. 4*a*.

Referring to FIG. 5*a*, which corresponds to the arrangement shown in FIGS. 3 and 4, a swellable packer 10 is disposed around the circumference of the casing 3. The swellable packer may be provided with a channel 36 through which the lateral tool 6 can pass through. Alternatively, the drill bit may be used to drill through the swellable packer. The swellable packer may be disposed so as to take some time to expand to its full extent, allowing fluid to circulate through the lateral tube and drive the drill bit when deployment of the lateral tube starts, as well as allowing the drilling fluid to circulate back up the annulus (the operation of the drill bit being described below in more detail). Alternatively, the channel 36 may be thinner than the diameter of the lateral tube, allow some fluid flow, and the drill bit enlarges the channel to pass through, or some other channel may be provided for fluid flow to drive the drill bit as it exits the casing window. The extent of the activation of the swellable packers may be controlled by the composition of the fluid being circulated.

The lateral tube 6 terminates in a rock drilling bit 15. Referring also to FIGS. 8 and 9, the drill bit is angled from the axis of the tube to provide an inclined drilling face 12 (sometimes referred to as a bent sub in the field of directional drilling). The drill bit is rotated by a fluid driven motor 13 driving a universal joint 14, attached to the rock drilling bit 15, which reacts on a bearing 16. The window 35 may have a counterbore from the outer surface of the casing 3 to accommodate the slightly wider outer diameter of the drilling bit 15.

Referring back to FIG. 5, on one side of the tubular member 11 are undulations 17 (more clearly visible in FIG. 9) which engage with spring-loaded fingers 26, 27 to prevent the tubular member 11 from rotating. These undulations are represented here as a series of depressions, but it is envisaged that they may more effectively be formed as a saw-tooth cam profile, which allows the spring-loaded fingers 26, 27 to slide over the profile in one direction (as the lateral tube 6 leaves the casing 3), but prevents movement in the reverse direction as the spring-loaded fingers encounter a ratchet surface (to prevent the lateral tube 6 retracting if pressure outside the casing increases). The cam profile typically has a regular periodicity between the undulations or saw-toothed shapes, and the spring-loaded fingers 26, 27 are separated by an and integral number plus one half of this interval, so that when one spring-loaded finger is between two ratchet points, the other finger has just engaged with a ratchet point. This principle could of course be extended or modified in known ways. The cammed profile runs axially along the tubular member 11, and may be contained within an axial groove or depression, or have raised axial walls on either side. In this manner, the tubular member 11 (and therefore the lateral tube 6 as a whole) is prevented from rotating as it passes through the window 35.

A seal 25 forms a dynamic pressure seal against the outside of the tubular member 11 and differential pressure across this seal ejects the tube, providing a controlled weight on bit cutting force. The spring loaded fingers 26, and 27 continue to engage with the undulating surface 17 thus preventing the tubular member 11 from rotating or retracting.

Referring to FIGS. 5*a*, 10 and 11, where the tubular swellable packer 10 encompasses the casing 3 and extends above and below the diameter of the windows 35. As the lateral tube 6 is forced out of the casing through the window 35, the swellable packer expand to form a seal around the lateral tube 6, so seal 25 may be dispensed with. Alternatively, seal 25 may be retained so that two seals are provided around the lateral tube 6.

Since the lateral tube 6 is restrained from rotation, the "bent" drilling face causes the lateral tube 6 to drill in a radius, ideally of approximately 10 ft (3.0 metres), when the lateral tube 6 has drilled 15.7 ft (4.8 metres) (i.e. has described a quarter circumference of a circle) have the end of the lateral tube 6 is oriented 90 degrees to the main bore. At this point the undulations end, and the lateral tube 6 is now free to rotate (in reaction to the rotating drill bit, and in some embodiments described below in reaction to the turbine or similar). As it is free to rotate the bent drilling face counter rotates relative to the drill itself, resulting in a straight hole being drilled; that is, though the drilling face is inclined, since the drilling face now rotates in the bore, the bore it drills is wider than its width but progresses to produce a substantially straight bore 38.

Referring back to FIG. 5 (in particular, the lower side showing the lateral tube at a later point of deployment), the tubular member 11 continues the extend out from the main bore until a small step 18 at the end of the tube (visible more clearly in FIGS. 8 and 9) reaches a shoulder 19 in the window bore 35 which constrains further outward movement. The step 18 may be (as shown here) in the form of a collet formed with somewhat resilient fingers that can snap into place, though a simple profile in the outer diameter could also be employed. A spring loaded pin 20 (rotation preventing pin 27 may be utilised for this purpose) prevents the tubular member 11 from coming back into the bore.

Depending on the type of material that makes up the formation (in particular, its structural integrity), the lateral tube (or at least a proportion of it) may not be required after the lateral bore has been formed. The tubular member 11 could be made from titanium, so that after the lateral bore has been fully drilled, hydrofluoric acid can be pumping into the tube to dissolve the tubular member. Alternatively, referring to FIGS. 8 and 9, the tubular member 11 could be made from stainless steel, and small titanium discs could be fitted into the stainless steel tube, so the lateral hole drilled could be supported open by the stainless steel tube, but the small discs 30 could be dissolved and provide passages for the wellbore fluid to enter the inside of the tube. The small discs could be different sizes 31, 32, 33, 34 getting larger the further from the main bore, so that the resultant inlet holes provide less resistance to inflow the deeper the tube 11 is in the lateral bore, to encourage a uniform draw down along the lateral bore length. Other soluble or frangible materials may be used.

The swellable packer 11 ensures that the formation fluid through the lateral tube 6 (or the lateral bore if the lateral tube has been dissolved) flows directly into the casing and cannot flow into the annulus. The material of a swellable packer may be chosen to be hydrocarbon-activated swellable material; thus, the hydrocarbon of the formation fluid helps maintain the integrity of the swellable packer during hydrocarbon production.

Referring to FIG. 7, an alternative drive mechanism for the drill bit could be a turbine 21, situated inside the main bore of the completion casing 3. Fluid is pumped down the main bore and passes through all the lateral tubes 6, driving each turbine. The fluid may be permitted to circulate back up the outside of the tubing annulus 8. Each turbine 21 in turn rotates a shaft 22 which would turn the bit 15. The turbine 21 and housing 23 may be made of a dissolvable material, so that once the tube was fully deployed, a solvent may be circulated to dissolve the turbine. For example, the turbine could be fabricated from magnesium, and the solvent could be an acetic acid.

Referring to FIG. 6, a plurality of lateral tubes 6 are typically disposed in a circular arrangement around the circumference of the casing 3 at a particular length or station of the casing. Referring also to FIGS. 12 and 13 each station or stage 40, 41, 42 has a plurality of lateral tubes which are deployed so that a large drainage radius can be penetrated. Each station could be every 40 ft (12 metres) along the wellbore, so for a 1000 ft (about 300 metres) horizontal well there could be 25×8=200 of these lateral tubes 6 penetrating into the reservoir.

Referring to FIGS. 14 to 17, in a further embodiment, the lateral tube 6 could be telescopic, with an inner tubular member 51, mounted inside an outer tubular member 52. Initially, the outer tubular member is expelled in a similar manner to the previously described embodiment, with undulations on its outer surface preventing the lateral tube from rotating. Once the tubular member 52 has been fully deployed, a shear pin 53 is activated (for example, by applying increasing the pressure of the main bore fluid) releasing the inner tubular member 51 and expelling it from the outer tubular member with differential pressure acting on the seal 54. Once fully deployed, a collet profile 55 (comprised of slightly radially flexible fingers of material) on the outer surface of the inner tubular member 51, lands in a internal profile 56 of the outer tubular member 52, locking the two tubular members together (alternatively, a abutting shoulder and profile such as shown in FIG. 5 to constrain the lateral tube to the casing could be used; also, the collet arrangement shown here could be used to constrain the lateral tube to the casing). As for the previous examples, dissolvable discs covering inlets 30, 31, 32, 33 are then removed by pumping a solvent fluid through the lateral tube, to leave open inlets 30-33 ready to receive formation fluid.

Just one telescopic inner tubular member is shown in the example, but clearly, more than one could be used nested inside each other.

Telescopic and non-telescopic lateral tubes, or lateral tubes having different numbers or lengths of telescopic sections, can be disposed in a mixed arrangement at each station. This would be advantageous in a thin reservoir section shown in FIG. 18, where it may be desired to have longer horizontal penetrations 60 into the reservoir than vertical ones 61, and to have mid length diagonal penetrations 62 going to the upper 63 and lower 64 limits of desired penetration.

Referring to FIG. 19, the lateral tube may terminate in a percussion drill which self-propels the tube out as it drills the new hole. The upper tubular portion of the tubular member tool 101 has a chamfer 102 on its outer lower edge to enable it to be welded to a tube 100 at an angle, so that the axis of tubular member tool 101 is inclined to that of tube 100, and thus the tubular member tool 101 produces a curved hole while rotation of the lateral tube is constrained.

The piston mechanism in general operates in a similar manner to that set out in WO2012069858 (which is incorporated herein by reference). The outer surface of the tubular portion of the tool 103 has a maximum outer diameter and the inner surface 104 has an inner diameter which is not less than the inner diameter of the upper tubular member (not here shown) of the lateral tube. All parts within these two diameters 103 and 104 are made from structural material. Tubular member 101 has an annular internal recess 105. A second tubular member 106 is located at the lower end of this recess, and is connected to member 101 by a set of straight keyways 107 and pins 108.

Member 106 can telescope (i.e. move from left to right in the figure) into the recess 105 the length of the keyway 107. At the lower end of member 106 is a set of keyways 109 which form a helical path. A pin 110 connects this keyway to member 111.

As member 106 moves up within recess 105 the annular member 111 is rotated by the distance of the helical keyway 109, this in turn transmits the torque through a ratchet mechanism 112 (which only allows rotation in one direction) to the lower annular part of the tool 113 on which the percussion drill head is attached. On the downward movement of the member 106, the ratchet mechanism 112 allows member 111 to rotate under the direction of the helical keyway, but disconnects the drive to the member 113. As member 106 moves up and down the lower annular part of the tool 113, only turns in the cutting direction. This would be preferably clockwise.

Referring to FIGS. 20 and 21, within the diameter 104 of the tool is a mechanism which achieves reciprocation movement from the fluid pumped internally through it. This is achieved as follows; fluid flows through passage 120 passing a spring 121 mounted in an annular chamber 122, through the centre port 123 of a reciprocating mass 125 which is attached to annular member 106. The fluid passes a valve 128, which has a ball at each end connected by an X cross sectioned stem 129 so fluid is in communication with chamber 130 via passage 131. The fluid flow pushes a ball 126 on a seat 127, this both generates a differential pressure across the seals 140, 141 and the fluid being pumped displaces the reciprocating mass 125 in an upward direction. Between the faces 142 of the valve 129 and 143 of the reciprocating mass 125, a spring 144 is compressed, and when fully compressed, it lifts the valve stem upward, lifting the ball 126 of the seat 127, causing pressure to vent below the tool. At the same time the spring 144 extends to its fully extended position 150. The upper surface 151 of the reciprocating mass 125 is compressing a spring 152 at this position, so this spring pushes the reciprocating mass downward causing the faces 155 and 156 to contact, providing a hammer or jarring effect.

The use of a percussion drill has several beneficial effects for a lateral drilling arrangement as described here. The percussion drill tends to pull itself along, and therefore can supplement or even replace the need for the lateral tube to be advanced through fluid pressure or some other means applied from the main bore or the surface. Secondly, the percussive or jarring action allows the drill to free itself and prevent itself getting jammed. Where a conventional drill may require weight on bit in order to advance, this can mean that when such a drill gets stuck, the weight on bit prevents the drill from freeing itself, instead keeping the bit tightly pushed against the end of the borehole in the jammed configuration. Using a percussion drill to the present design however reduces this occurrence since little or no weight-on-bit need be applied along the lateral tube (since the percussion tool has the effect of forcing itself along by the nature of the quick release of momentum on the hammer stroke), it is less likely to become jammed in this manner, and the hammering and jarring action of the percussive drill also tends to free the bit in such circumstances.

Although in the embodiments above, the tools that form the secondary bores are described as a lateral tube, and 90° is noted as the desired angle, it will be appreciated that secondary bores may be produced from the main bore at different inclinations of orientations using the same principles.

The invention claimed is:

1. An apparatus for drilling a lateral bore to main bore, comprising:
   - a casing in the main bore, the casing having at least one aperture;
   - at least one lateral tube, including a bit or other soil penetrator, the lateral tube engaging with an aperture in the casing, the outer diameter of the lateral tube being flush with the aperture;
   - the lateral tube is prevented from rotating while exiting the casing, and entering the formation for a first time period such as to produce a curved bore until a predetermined or desired orientation between the lateral and main bore has been achieved, and at the end of the first time period, the lateral tube is free to rotate to enable a straight section of lateral hole to be drilled.

2. An apparatus according to claim 1, wherein the lateral tube includes a shaped surface or groove along one side in which part of the casing engages.

3. An apparatus according to claim 1, wherein a percussion bit is used.

4. An apparatus according to claim 3, wherein a percussion bit is fluid powered.

5. An apparatus according to claim 1, wherein the lateral tube is flush with the aperture, such that the lateral tube is forced through the casing aperture into the formation when a sufficient pressure differential between the inside of the casing and the outside of the casing.

6. An apparatus according to claim 1, wherein a plurality of packers disposed at intervals along the outside of the casing, capable of sealing the annulus to the passage of fluids.

7. An apparatus according to claim 1, wherein the lateral tube comprises two or more concentric sleeves, which are free to move over each other telescopically to extend the lateral tube into the formation.

8. An apparatus according to claim 7, wherein the outer sleeve is arranged to drill the curved section of the lateral hole, and inner tube arranged to drill straight section of the lateral hole.

9. An apparatus according to claim 1, wherein there is included a stop member, which engages with a profile on the lateral tube to prevent the tube from leaving the main casing and also prevent the tube from coming back into the main casing, to leave a flush ID.

10. An apparatus according to claim 1, wherein the lateral tube includes a plurality of acid soluble ports on the tube to allow the passage of oil well fluids.

11. An apparatus according to claim 1, wherein the lateral tube is fabricated from material soluble in acid.

12. An apparatus according to claim 10, wherein the ports proximal to the main bore are larger than ports more distally located such as to provide a uniform production along the tube length.

13. An apparatus according to claim 1, wherein the flush fit with the aperture in the casing is provided at least in part by a swellable packer.

14. A drilling apparatus for drilling a lateral bore to main bore, comprising:
   - a casing in the main bore, the casing having at least one aperture;
   - at least one lateral tube, including a bit or other soil penetrator, the lateral tube extendable through an aperture in the casing;
   - the bit or other soil penetrator being a percussion drill;
   - the lateral tube engaging with an aperture in the casing, the outer diameter of the lateral tube being flush with the aperture;
   - the lateral tube being prevented from rotating while exiting the casing and entering the formation for a first time period until a predetermined or desired orientation between the lateral and main bore has been achieved, and at the end of the first time period, the lateral tube is free to rotate to enable a straight section of lateral hole to be drilled.

15. A drilling apparatus according to claim 14, wherein the percussion drill is fluid powered.

16. An apparatus for drilling a lateral bore to main bore, comprising:
   - a casing in the main bore, the casing having at least one aperture at least one lateral tube, including a bit or other soil penetrator, the lateral tube extending from the aperture in the casing, the bit being a percussion drill;
   - the lateral tube engaging with the aperture in the casing, the outer diameter of the lateral tube being flush with the aperture;
   - the lateral tube being prevented from rotating while exiting the casing and entering the formation for a first time period until a predetermined or desired orientation between the lateral and main bore has been achieved, and at the end of the first time period, the lateral tube is free to rotate to enable a straight section of lateral hole to be drilled.

17. An apparatus according to claim 16, wherein a percussion bit is fluid powered.

18. An apparatus according to claim 17, wherein the lateral tube includes a shaped surface or groove along one side in which part of the casing engages.

19. An apparatus according to claim 16, wherein the lateral tube is flush with the aperture, such that the lateral tube is forced through the casing aperture into the formation when a sufficient pressure differential between the inside of the casing and the outside of the casing.

20. An apparatus according to claim 16, wherein a plurality of packers disposed at intervals along the outside of the casing, capable of sealing the annulus to the passage of fluids.

* * * * *